US010096302B2

(12) United States Patent
Roh et al.

(10) Patent No.: US 10,096,302 B2
(45) Date of Patent: Oct. 9, 2018

(54) DISPLAY SYSTEM

(71) Applicant: SAMSUNG ELECTRONICS CO., LTD., Suwon-si, Gyeonggi-Do (KR)

(72) Inventors: Jong Ho Roh, Yongin-si (KR); Bong Il Park, Seongnam-si (KR)

(73) Assignee: SAMSUNG ELECTRONICS CO., LTD., Suwon-si, Gyeonggi-Do (KR)

( * ) Notice: Subject to any disclaimer, the term of this patent is extended or adjusted under 35 U.S.C. 154(b) by 65 days.

(21) Appl. No.: 14/683,409

(22) Filed: Apr. 10, 2015

(65) Prior Publication Data

US 2015/0294647 A1 Oct. 15, 2015

(30) Foreign Application Priority Data

Apr. 11, 2014 (KR) ..... 10-2014-0043479

(51) Int. Cl.
*G09G 5/18* (2006.01)
*G09G 5/12* (2006.01)

(52) U.S. Cl.
CPC ..... *G09G 5/18* (2013.01); *G09G 5/12* (2013.01); *G09G 2330/021* (2013.01); *G09G 2340/0435* (2013.01)

(58) Field of Classification Search
CPC ..... G09G 5/12; G09G 5/18; G09G 5/006; G09G 5/008; G09G 2310/08; G09G 2330/021; G09G 2340/0435
USPC ..... 345/213, 214, 3.1, 3.2
See application file for complete search history.

(56) References Cited

U.S. PATENT DOCUMENTS

| | | | | |
|---|---|---|---|---|
| 6,504,533 | B1 * | 1/2003 | Murayama | G09G 5/008 345/204 |
| 7,142,187 | B1 | 11/2006 | Kim et al. | |
| 7,626,616 | B2 | 12/2009 | Kokubo et al. | |
| 7,834,866 | B2 | 11/2010 | Ogawa | |
| 7,969,507 | B2 | 6/2011 | Kim | |
| 8,223,106 | B2 | 7/2012 | Shin | |
| 2008/0278465 | A1 * | 11/2008 | Katou | G09G 5/18 345/204 |
| 2012/0182332 | A1 | 7/2012 | Liu | |

FOREIGN PATENT DOCUMENTS

| | | |
|---|---|---|
| JP | 2012-175635 | 9/2012 |
| KR | 100661167 | 12/2006 |
| KR | 1020100005978 | 1/2010 |

* cited by examiner

*Primary Examiner* — Jimmy H Nguyen
(74) *Attorney, Agent, or Firm* — F. Chau & Associates, LLC

(57) ABSTRACT

A display system is provided. The display system includes a perframe controller configured to receive a frame synchronization signal and to change values of M and N in synchronization with at least one pulse of the frame synchronization signal, where M and N are natural numbers; and a fractional divider configured to generate and output a pixel clock signal by dividing an input clock signal by a division ratio of N/M.

11 Claims, 9 Drawing Sheets

FIG. 5

| Frame No. | LUT Value | Frame Rate |
|---|---|---|
| X | M=60, N=60 | 60 fps |
| X+1 | M=55, N=60 | 55 fps |
| X+2 | M=53, N=60 | 53 fps |

DISPLAY SYSTEM

CROSS-REFERENCE TO RELATED APPLICATIONS

This application claims priority under 35 U.S.C. § 119(a) to Korean Patent Application No. 10-2014-0043479 filed on Apr. 11, 2014, the disclosure of which is incorporated by reference in its entirety herein.

BACKGROUND

1. Technical Field

Embodiments of the inventive concept relate to a display system.

2. Discussion of Related Art

With the increase in resolution of display panels in mobile system-on-chip (SoC) technology, a low-power design for a display interface has become important. The rate at which an imaging device produces unique consecutive images for display on a display panel may be referred to as a frame rate. The frame rate of a display panel may be controlled using a clock signal of a particular frequency, which may be generated by a phase locked loop (PLL). Power consumption by the display panel can be reduced by adaptively adjusting the frame rate. For instance, the frequency of a clock signal output by the PLL can be divided by an integer N to adjust the frame rate. However, with this method, it is difficult to precisely control the frame rate and it can result in great changes in the frame rate that are perceivable by those viewing the display panel.

SUMMARY

According to an exemplary embodiment of the inventive concept, there is provided a display system including a controller (e.g., a perframe controller) configured to receive a frame synchronization signal and to change values of M and N in synchronization with at least one pulse of the frame synchronization signal, where M and N are natural numbers; and a fractional divider configured to generate and output a pixel clock signal by dividing an input clock signal by a division ratio of N/M.

The display system may further include a memory configured to store at least one look-up table. The perframe controller may change the values of M and N with reference to one of the at least one look-up table.

The perframe controller may sequentially change the values of M and N for each of sequential frames according to the look-up table in synchronization with the pulse of the frame synchronization signal.

Alternatively, the perframe controller may receive a scenario signal relating to an operation scenario of the display system and refer to one of the at least one look-up table according to the scenario signal.

The perframe controller may change the values of M and N within a time period while the at least one pulse occurs in the frame synchronization signal and the fractional divider may change a frequency of the pixel clock signal in the time period according to the values of M and N.

The pixel clock signal may have a duty ratio less or greater than 50%.

The frame synchronization signal may be either a vertical synchronization signal or a horizontal synchronization signal.

The display system may further include a display controller configured to adjust a frame rate of the display system according to the pixel clock signal.

The display system may be implemented as one of an application processor, a system-on-chip, or a television system.

The perframe controller and the fractional divider may be included in a clock management unit of the application processor.

According to an exemplary embodiment of the inventive concept, there is provided a display system including a display controller configured to generate a frame synchronization signal and a pixel clock controller configured to change a frequency of a pixel clock signal in synchronization with at least one pulse of the frame synchronization signal. The display controller changes a frame rate according to the pixel clock signal.

The pixel clock controller may include a perframe controller configured to change values of M and N in synchronization with the at least one pulse, where M and N are natural numbers; and a fractional divider configured to generate the pixel clock signal by dividing an input clock signal by a division ratio of N/M.

The display system may further include a memory configured to store at least one look-up table. The perframe controller may change the values of M and N with reference to one of the at least one look-up table.

The perframe controller may sequentially change the values of M and N for each of sequential frames according to the look-up table in synchronization with the pulse of the frame synchronization signal.

The pixel clock controller may change the frequency of the pixel clock signal in a time period while the at least one pulse occurs in the frame synchronization signal.

According to an exemplary embodiment of the inventive concept, a display system is provided that includes a display device, a fractional divider, and a controller. The display device is configured to display images only outside a period while a pulse occurs within a frame synchronization signal. The fraction divider is configured to divide an input clock signal by a division ratio of N/M only within the period to generate a pixel clock signal, where N and M are natural numbers. The controller is configured to generate the frame synchronization and output image data to the display device according to the pixel clock signal.

A value of a frequency of the pixel clock signal may be proportional to a value of a frame rate of the display device.

The display system may further include a second controller that is configured to change values of the N and M to new values only within the period.

The second controller may change the values by determining a frame number of the synchronization signal, retrieving the new values from an entry in a lookup table corresponding to the frame number, and setting the values to the new values, respectively.

The frame synchronization signal may be vertical or a horizontal synchronization signal.

BRIEF DESCRIPTION OF THE DRAWINGS

The inventive concept will become more apparent by describing in detail exemplary embodiments thereof with reference to the attached drawings in which:

FIG. 5 is a diagram showing examples where the values M and N illustrated in FIG. 3 change;

DETAILED DESCRIPTION

Figure 1:
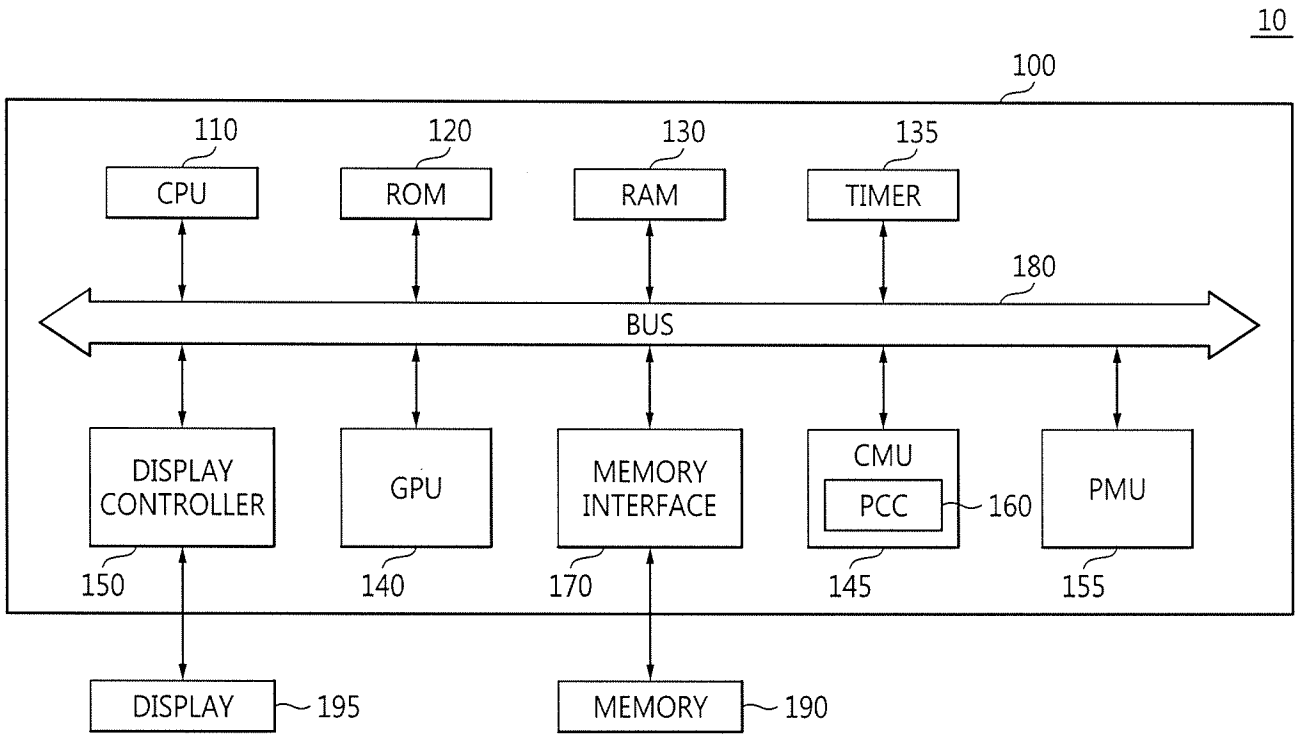
FIG. 1 is a block diagram of an electronic system according to an exemplary embodiment of the inventive concept.

The inventive concept now will be described more fully hereinafter with reference to the accompanying drawings, in which embodiments of the inventive concept are shown. This inventive concept may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity. Like numbers refer to like elements throughout.

It will be understood that when an element is referred to as being "connected" or "coupled" to another element, it can be directly connected or coupled to the other element or intervening elements may be present. As used herein, the singular forms "a", "an" and "the" are intended to include the plural forms as well, unless the context clearly indicates otherwise.

FIG. 1 is a block diagram of an electronic system 10 according to an exemplary embodiment of the inventive concept. The electronic system 10 may be implemented as a handheld device such as a cellular telephone, a smart phone, a tablet computer, a personal digital assistant (PDA), an enterprise digital assistant (EDA), a digital still camera, a digital video camera, a portable multimedia player (PMP), a personal navigation device or portable navigation device (PND), a handheld game console, or an e-book reader. The electronic system 10 includes a system-on-chip (SoC) 100, a memory device 190, and a display device 195.

The SoC 100 may be an application processor (AP). The SoC 100 may include a central processing unit (CPU) 110, a read-only memory (ROM) 120, a random access memory (RAM) 130, a timer 135, a graphics processing unit (GPU) 140, a clock management unit (CMU) 145, a display controller 150, a memory interface 170, and a bus 180. The SoC 100 may also include other elements. The electronic system 10 may also include a power management unit (PMU) 155. The PMU 155 is implemented inside the SoC 100 in the embodiments illustrated in FIG. 1, but the PMU 155 may be implemented outside the SoC 100 in other embodiments.

The CPU 110, which may be referred to as a processor, may process or execute programs and/or data stored in the memory device 190. For instance, the CPU 110 may process or execute the programs and/or the data in response to a clock signal output from a clock signal generator (not shown). The CPU 110 may be implemented as a multi-core processor. The multi-core processor is a single computing component with two or more independent actual processors (referred to as cores). Each of the processors reads and executes program instructions. Since the multi-core processor can drive a plurality of accelerators at a time, a data processing system including the multi-core processor can perform multi-acceleration.

The programs and/or the data stored in the ROM 120, the RAM 130, and the memory device 190 may be loaded into memory in the CPU 110 when necessary. The ROM 120 may store permanent programs and/or data. The ROM 120 may be implemented as erasable programmable ROM (EPROM) or an electrically erasable programmable ROM (EEPROM).

The RAM 130 may temporarily store programs, data, or instructions. The programs and/or data stored in the memory 120 or 190 may be temporarily stored in the RAM 130 according to the control of the CPU 110 or a booting code stored in the ROM 120. The RAM 130 may be implemented as a dynamic RAM (DRAM) or a static RAM (SRAM).

The GPU 140 may process data read by the memory interface 170 from the memory device 190 into a signal suitable to be displayed. The GPU 140 may be designed to rapidly manipulate and alter memory to accelerate the creation of images in a frame buffer intended for output to a display.

The CMU 145 generates an operating clock signal and may control the output of the operating clock signal. The CMU 145 may include a clock signal generator such as a phase locked loop (PLL), a delay locked loop (DLL), or a crystal oscillator and a clock generator. The CMU 145 may provide the operating clock signal for the elements 110 through 170.

The CMU 145 includes a pixel clock controller (PCC) 160. In an exemplary embodiment, the PCC 160 is located outside the CMU 145. An embodiment of the structure and operation of the PCC 160 will be described with reference to FIGS. 2 through 4 below.

The memory interface 170 interfaces with the memory device 190. The memory interface 170 controls the overall operation of the memory device 190 and controls overall data exchange between a host and the memory device 190. For instance, the memory interface 170 may write data to the memory device 190 or read data from the memory device 190 at the request of the host. As an example, the host may be a processing unit such as the CPU 110, the GPU 140, or the display controller 150.

The memory device 190 is a storage medium for storing data and it may store an operating system (OS) and various kinds of programs and data. The memory device 190 may be DRAM, but the inventive concept is not restricted thereto. For instance, the memory device 190 may be a non-volatile memory such as flash memory, phase-change RAM (PRAM), magnetoresistive RAM (MRAM), resistive RAM (ReRAM) or ferroelectric RAM (FeRAM). In an exemplary embodiment, the memory device 190 is an embedded memory provided within the SoC 100. The elements 110, 120, 130, 140, 150, 155, and 170 may communicate with one another through the bus 180.

In an embodiment, the display device 195 receives a frame synchronization signal and an output image signal from the display controller 150 and displays the output image signal according to the frame synchronization signal. The display device 195 may be implemented as a liquid crystal display (LCD) device, a light emitting diode (LED)

display device, an organic LED (OLED) display device, or an active-matrix OLED (AMOLED) display device.

The display device 195 may operate in a video mode according to a mobile industry processor interface (MIPI), but the inventive concept is not restricted thereto. The display controller 150 may control the operation of the display device 195.

Figure 2:
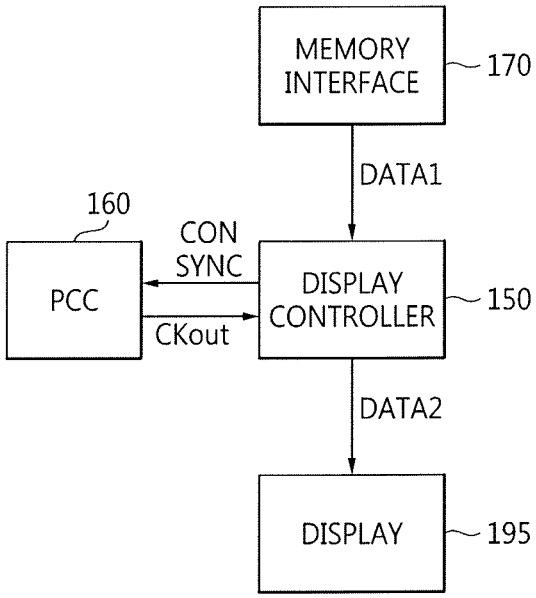
FIG. 2 is a block diagram showing the operation of a display controller illustrated in FIG. 1 according to an exemplary embodiment of the inventive concept.

FIG. 2 is a block diagram showing the operation of the display controller 150 illustrated in FIG. 1 according to an exemplary embodiment of the inventive concept. In an exemplary embodiment, the display controller 150 is a processor or a microprocessor. Referring to FIGS. 1 and 2, the display controller 150 receives first data DATA1 from the memory interface 170. The first data DATA1 may include data related with at least one image. For example, the first data DATA1 may include one or more frames of image data. In other embodiments, the display controller 150 may receive the first data DATA1 from the CPU 110, the ROM 120, the RAM 130, or the GPU 140.

The display controller 150 generates a frame synchronization signal SYNC. The frame synchronization signal SYNC may be a vertical synchronization signal VSYNC, a horizontal synchronization signal HSYNC, or a signal related with at least one of the vertical synchronization signal VSYNC and the horizontal synchronization signal HSYNC. The frame synchronization signal SYNC may include a start packet and an end packet. The start packet may be generated in response to a rising edge of the vertical synchronization signal VSYNC and the end packet may be generated in response to a falling edge of the vertical synchronization signal VSYNC.

The display controller 150 outputs the frame synchronization signal SYNC and a control signal CON to the PCC 160. In other embodiments, the control signal CON may be generated by another module (e.g., the CPU 110 or the GPU 140) apart from the display controller 150.

The control signal CON may be related with an update rate of the first data DATA1 or the second data DATA2. For example, the control signal CON may indicate the rate at which frames of image data of the first data DATA1 or the second data DATA2 are to be presented on the display 195. The update rate may be a value related to data characteristics of the first data DATA1 or the second data DATA2. For instance, when the first data DATA1 includes still image data, the update rate is low, and therefore, the control signal CON includes a command to decrease a frequency of a pixel clock signal CKout according to the update rate. Alternatively, when the first data DATA1 includes moving image data, the update rate is high, and therefore, the control signal CON includes a command to increase a frequency of the pixel clock signal CKout according to the update rate. In an exemplary embodiment, the update rate of moving image data is higher than the update rate of still image data. When there are no changes or small changes (e.g., below a threshold) to an image, the frequency of the pixel clock signal CKout and the frame rate can be decreased to save power.

The update rate may be a rate at which a frame buffer is updated, that is, a rate at which the first data DATA1 is updated. The CPU 110 may operate in various modes (e.g., video playback mode and camera preview mode) by executing software. When the CPU 110 operates in the video playback mode, as an example, the first data DATA1 is video source data with an update rate of 30 frames per second (fps), and the frame rate is set to 60 fps. The frame rate can be decreased to 30 fps according to the update rate to save power.

The PCC 160 generates the pixel clock signal CKout for output to the display controller 150. In an exemplary embodiment, the PCC 160 changes the frequency of the pixel clock signal CKout according to the frame synchronization signal SYNC and the control signal CON. In an exemplary embodiment, the PCC 160 changes the frequency of the pixel clock signal CKout within a time period (hereinafter, referred to as a sync period) while at least one pulse occurs in the frame synchronization signal SYNC. Since the display device 195 does not display images during the sync period, a side effect in which a frame rate change is perceived by users is prevented and potential factors influencing the quality of pictures are eliminated when the frame rate is adjusted in the sync period.

The display controller 150 may adjust the frame rate according to the pixel clock signal CKout and may adjust the frame synchronization signal SYNC. A value of a frequency of the pixel clock signal CKout may be proportional to a value of the frame rate. The display controller 150 may process at least one image (e.g., blend a plurality of images) included in the first data DATA1 and adjust output timing according to the frame synchronization signal SYNC so as to generate the second data DATA2. The display controller 150 may output the second data DATA2 to the display device 195.

Figure 3A:
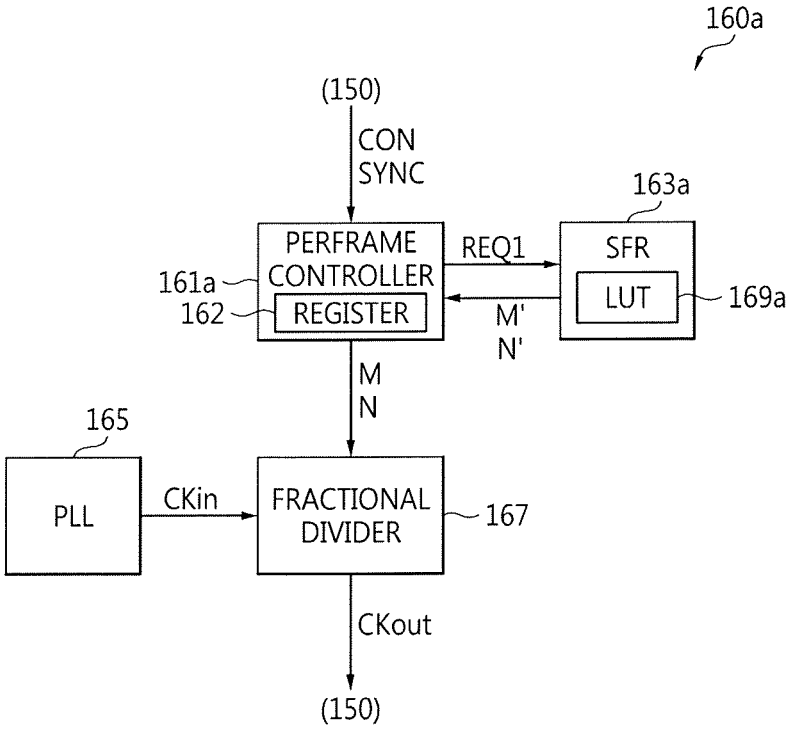
FIG. 3A is a diagram of an example of a pixel clock controller (PCC) illustrated in FIG. 2.
Figure 3B:
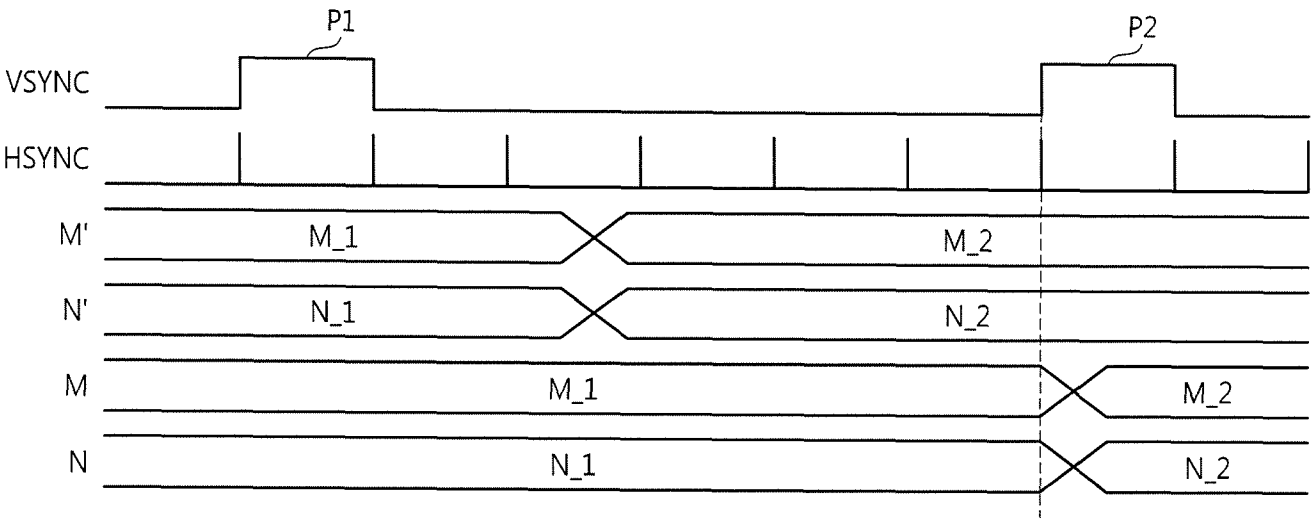
FIG. 3B is a timing chart showing a case where values M and N change.
Figure 4:
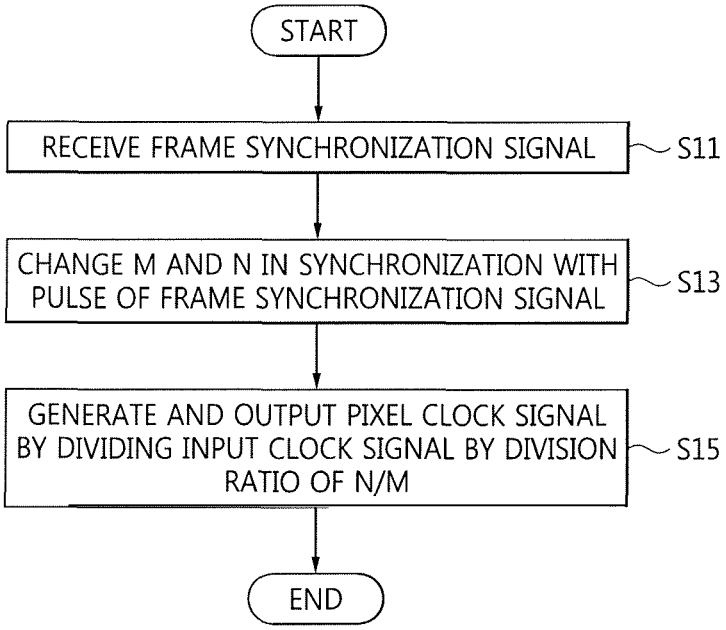
FIG. 4 is a flowchart of the operation of the PCC illustrated in FIG. 3A according to an exemplary embodiment of the inventive concept.

FIG. 3A is a diagram of an example 160*a* of the PCC 160 illustrated in FIG. 2 according to an exemplary embodiment of the invention concept. FIG. 3B is a timing chart showing a case where values M and N change. FIG. 4 is a flowchart of the operation of the PCC 160*a* illustrated in FIG. 3A according to an exemplary embodiment of the invention. FIG. 5 is a diagram showing examples where the values M and N illustrated in FIG. 3 change. Referring to FIG. 1 and FIGS. 3A through 5, the PCC 160*a* includes a perframe controller 161*a*, a memory 163*a*, an input clock generator 165, and a fractional divider 167. In an exemplary embodiment, the perframe controller 161*a* is a processor.

The perframe controller 161*a* receives the frame synchronization signal SYNC from the display controller 150 in operation S11. Hereinafter, it is assumed that the frame synchronization signal SYNC is the vertical synchronization signal VSYNC in the embodiments, but the inventive concept is not restricted thereto. For instance, the frame synchronization signal SYNC may be a signal related to the vertical synchronization signal VSYNC and the horizontal synchronization signal HSYNC. The perframe controller 161*a* may also receive the control signal CON from the display controller 150, the CPU 110, or the GPU 140.

The perframe controller 161*a* includes a shadow register 162. The shadow register 162 stores the values M and N, where M and N are natural numbers. The values M and N may be used to determine the frequency of the pixel clock signal CKout.

The perframe controller 161*a* may operate in synchronization with pulses of the frame synchronization signal SYNC. In an exemplary embodiment, the perframe controller 161*a* counts pulses P1 and P2 of the vertical synchronization signal VSYNC to extract a frame number. In an exemplary embodiment, the perframe controller 161*a* decides whether to change the frequency of the pixel clock signal CKout according to the control signal CON and transmits a reference request signal REQ1 to the memory 163*a*. The reference request signal REQ1 may include the frame number, information about whether to increase or decrease the frequency of the pixel clock signal CKout, and a target frequency according to the change in the frequency of the pixel clock signal CKout.

The memory 163*a* may be implemented as a special function register (SFR) and may include at least one look-up table (LUT) 169*a*. The LUT 169*a* may store a frame number and values M' and N' (where M' and N' are natural numbers) corresponding to the frame number or values respectively corresponding to the values M' and N'. The values M' and N' may be determined according to the characteristics of a display panel. Although the memory 163*a* is illustrated in FIG. 3A as being included in the PCC 160 (e.g., 160*a*) within the CMU 145, the memory 163*a* may be located outside the PCC 160 or the CMU 145 in other embodiments.

The perframe controller 161*a* may receive the values M' and N' by referring to one of the at least one LUT 169*a* according to the reference request signal REQ1 and may change the values M and N into the received values M' and N' in operation S13. In an exemplary embodiment, the change of the values M and N occurs within a sync period while the frame synchronization signal SYNC is at a predetermined level (e.g., a period while the pulse P1 or P2 occurs in the vertical synchronization signal VSYNC). In other embodiments, the change of the values M and N occurs in response to a level transition (e.g., a rising edge or falling edge) of the frame synchronization signal SYNC. For example, the change of the values of M and N may occur at a rising or falling edge of pulse P1 or P2.

When the frequency of the pixel clock signal CKout is changed according to the control signal CON, the perframe controller 161*a* may transmit the reference request signal REQ1 to the memory 163*a*. The memory 163*a* may output M_1 and N_1 as the values M' and N' until receiving the reference request signal REQ1 and may output M_2 and N_2 as the values M' and N' in response to the reference request signal REQ1. The change of the output value of the memory 163*a* may occur at a time point that is independent of the frame synchronization signal SYNC. In an exemplary embodiment, the perframe controller 161*a* changes the values M and N from M_1 and N_1 to M_2 and N_2 in response to a rising edge of the vertical synchronization signal VSYNC and outputs the changed values M and N to the fractional divider 167.

The input clock generator 165 may be implemented as a PLL, a DLL, or a crystal oscillator to generate an input clock signal CKin. The fractional divider 167 may receive the input clock signal CKin and the values M and N that have been changed by the perframe controller 161*a*. The fractional divider 167 generates the pixel clock signal CKout by dividing the input clock signal CKin by a division ratio of N/M and outputs the pixel clock signal CKout to the display controller 150 in operation S15. In an exemplary embodiment, N and M are different from one another. In an exemplary embodiment, the duty ratio of the pixel clock signal CKout is less than or greater than 50%. The fractional divider 167 may be implemented using a plurality of T flip-flops and a multiplexer in an exemplary embodiment, but the inventive concept is not restricted thereto as the fractional divider 167 may be implemented in various ways.

The fractional divider 167 changes the frequency of the pixel clock signal CKout during the sync period of the frame synchronization signal SYNC according to the values M and N and may output the pixel clock signal CKout having the changed frequency. In other words, when the frequency of the input clock signal CKin is represented with "Fin" and the frequency of the pixel clock signal CKout is represented with "Fout", Fout may be determined by the following equation: $Fout=Fin\times1/(N/M)$.

According to an exemplary embodiment, the perframe controller 161*a* sequentially changes the values M and N for each of sequential frames according to the LUT 169*a* in synchronization with a pulse of the frame synchronization signal SYNC. For instance, the frame synchronization signal SYNC may include first through third pulses which occur sequentially. The first pulse may correspond to frame X (where X is a natural number), the second pulse may correspond to frame X+1, and the third pulse may correspond to frame X+2. The perframe controller 161*a* may set the values M and N to 60 each within a time period while the first pulse occurs. The perframe controller 161*a* may set the values M and N to 55 and 60, respectively, within a time period while the second pulse occurs. The perframe controller 161*a* may set the values M and N to 53 and 60, respectively, within a time period while the third pulse occurs.

The frame rate may be changed in proportion to the frequency Fout of the pixel clock signal CKout. Accordingly, when M=60, N=60, and the frame rate is 60 fps for frame X; the frame rate may be changed to 60×55/60=55 fps for frame X+1 and to 60×53/60=53 fps for frame X+2. Although only the value M is changed with respect to a frame number in the embodiments illustrated in FIG. 5, both of the values M and N may be changed in other embodiments. When the values M and N are set to a 6-bit value, the frame rate can be controlled in 1 Hz units.

According to an exemplary embodiment of the inventive concept, a frame rate is adjusted by only adjusting the variables M and N without increasing (or decreasing) the frequency of an input clock signal, so that the frame rate can be more precisely controlled with less power consumption. For example, the frequency of the input clock signal can be constant.

Figure 6:
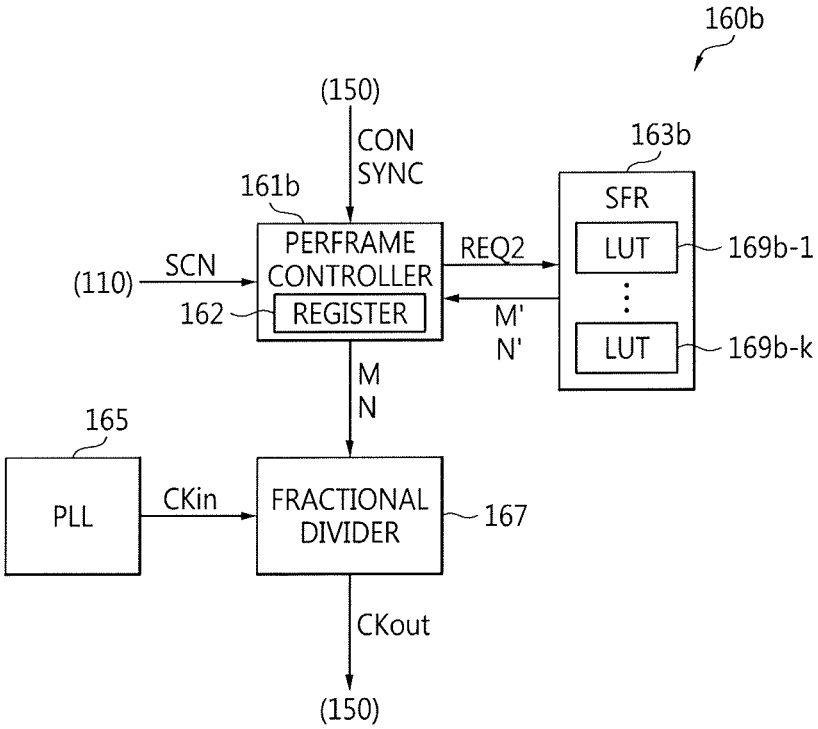
FIG. 6 is a diagram of another example of the PCC illustrated in FIG. 2 according to an exemplary embodiment of the inventive concept.

FIG. 6 is a diagram of another example 160*b* of the PCC 160 illustrated in FIG. 2 according to an exemplary embodiment of the inventive concept. The structure of the PCC 160*b* illustrated in FIG. 6 is nearly the same as that of the PCC 160*a* illustrated in FIG. 3A, and therefore, differences therebetween will be described in detail to avoid redundancy. In an exemplary embodiment, the PCC 160*b* is implemented by a processor.

A perframe controller 161*b* receives a scenario signal SCN relating to an operation scenario of a display system. For example, the scenario signal SCN may indicate one type of operation scenario from among a plurality of different types of operation scenarios. The indicated operation scenario may correspond to one of output of television images, a camera preview, a video play, and so on. In an exemplary embodiment, the voltage level or bit pattern of the scenario signal SCN for each scenario are different from one another. Since features influencing the quality of pictures may be different according to the operation scenario, using different LUTs may be efficient.

The memory 163*b* stores a plurality of LUTs 169*b*-1 through 169*b*-*k*. The LUTs 169*b*-1 through 169*b*-*k* may respectively correspond to a different one of the operation scenarios. For example, when the scenario signal SCN indicates that a first operation scenario is to be used, a first LUT 169*b*-1 is referenced, when the scenario signal SCN indicates that a second other operation scenario is to be used, a second LUT 169*b*-2 is referenced, etc. The perframe controller 161*b* transmits a reference request signal REQ2 to the memory 163*b* according to the scenario signal SCN and may change the values M and N with reference to an LUT corresponding to the scenario signal SCN among the LUTs 169*b*-1 through 169*b*-*k*. For example, the reference request signal REQ2 can be used to select one of the LUTs 169*b*-1 through 169*b*-*k* to retrieve a corresponding pair of M' and N' values.

Figure 7A:
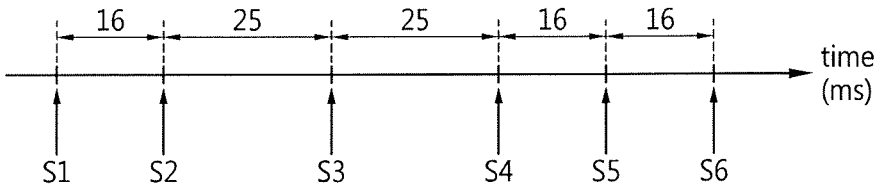
FIGS. 7A and 7B are diagrams illustrating changes in a frame rate.
Figure 7B:
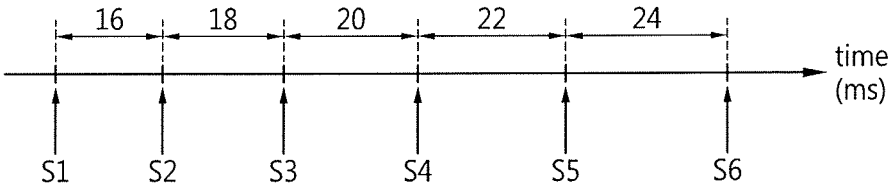

FIGS. 7A and 7B are diagrams illustrating changes in a frame rate. Referring to FIG. 7A, reference characters S1 through S6 each denote a time when a pulse of a frame synchronization signal occurs. When the frame rate of a display system is decreased from 60 fps to 40 fps using a fractional-N divider, it is may be difficult or impossible to precisely control the frame rate. In detail, the pulses between S1 and S2 are output at an interval of 16 ms (i.e., at a frame rate of 60 fps) and then the pulses between S3 and S4 are output at an interval of 25 ms (i.e., at a frame rate of 40 fps). In this case, flickers may occur and the change in the frame rate may be perceived by users.

Referring to FIG. 7B, a frequency is divided by a ratio of N/M, and therefore, the interval between pulses can be gradually increased from 16 to 25 ms and the frame rate can be more precisely controlled. As a result, flickers are prevented and users cannot perceive the change in the frame rate.

Figure 8:
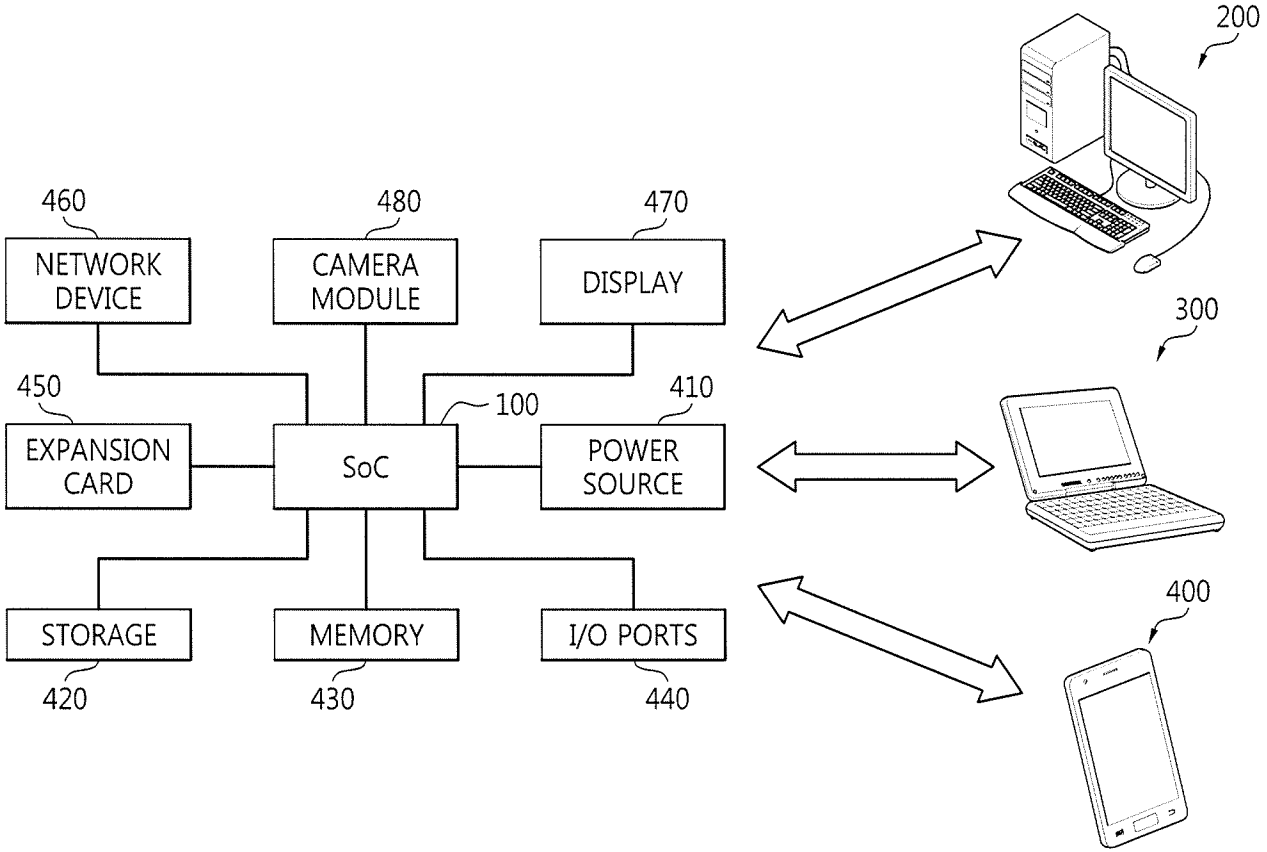
FIG. 8 is a block diagram of an electronic system including the SoC illustrated in FIG. 1 according to an exemplary embodiment of the inventive concept.

FIG. 8 is a block diagram of an electronic system including the SoC illustrated in FIG. 1. Referring to FIG. 8, the electronic system may be implemented as a PC or a data server 200, a laptop computer 300 or a portable device 400.

The portable device 400 may be a cellular phone, a smart phone, a tablet personal computer (PC), a personal digital assistant (PDA), an enterprise digital assistant (EDA), a digital still camera, a digital video camera, a portable multimedia player (PMP), a portable navigation device (PND), a handheld game console, or an e(electronic)-book reader device.

The electronic system 200, 300 or 400 includes the SoC 100, a power source 410, a storage device 420, a memory 430, I/O ports 440, an expansion card 450, a network device 460, and a display 470. According to an exemplary embodiment of the inventive concept, the electronic system 200, 300 or 400 further includes a camera module 480.

The SoC 100 may be the SoC 100 illustrated in FIG. 1. The SoC 100 may control the operation of at least one of the elements 410 through 480. The power source 410 may supply an operating voltage to at least one of the elements 100, and 420 through 480. The storage device 420 may be implemented by a hard disk drive (HDD) or a solid state drive (SSD).

The memory 430 may be implemented by a volatile or non-volatile memory. The memory 430 may correspond to the memory device 190 illustrated in FIG. 1. A memory controller (not shown) that controls a data access operation (e.g., a read operation, a write operation (or a program operation), or an erase operation) on the memory 430 may be integrated into or embedded in the SoC 100. Alternatively, the memory controller may be provided between the SoC 100 and the memory 430.

The I/O ports 440 are ports that receive data transmitted to the electronic system 200, 300 or 400 or transmit data from the electronic system 200, 300 or 400 to an external device. For instance, the I/O ports 440 may include a port connecting with a pointing device such as a computer mouse, a port connecting with a printer, and a port connecting with a universal serial bus (USB) drive.

The expansion card 450 may be implemented as a secure digital (SD) card or a multimedia card (MMC). The expansion card 450 may be a subscriber identity module (SIM) card or a universal SIM (USIM) card.

The network device 460 enables the electronic system 200, 300 or 400 to be connected with a wired or wireless network. The display 470 displays data output from the storage device 420, the memory 430, the I/O ports 440, the expansion card 450, or the network device 460.

The camera module 480 converts optical images into electrical images. Accordingly, the electrical images output from the camera module 480 may be stored in the storage device 420, the memory 430, or the expansion card 450. Also, the electrical images output from the camera module 480 may be displayed through the display 470.

The inventive concept may be applied to television (TV) systems or other display systems. For example, the more the number of pixels of the display device increases, the more the power consumption increases. Thus, the display device can generate a large amount of heat. According to an exemplary embodiment of the inventive concept, a frame rate is more precisely adjusted by considering the update rate of the output image. Thus, power consumption can be reduced without affecting image quality.

The inventive concept can also be embodied as computer-readable codes on a computer-readable medium. The computer-readable recording medium is any data storage device that can store data as a program which can be thereafter read by a computer system. Examples of the computer-readable recording medium include read-only memory (ROM), random-access memory (RAM), CD-ROMs, magnetic tapes, floppy disks, and optical data storage devices.

The computer-readable recording medium can also be distributed over network coupled computer systems so that the computer-readable code is stored and executed in a distributed fashion. Also, a program code for performing the methods of object information estimation according to embodiment of the present inventive concept may be sent in the form of carrier wave (e.g., transmission through the Internet). Also, functional programs, codes, and code segments to accomplish the present inventive concept can be construed by programmers skilled in the art to which the present inventive concept pertains.

As described above, according to at least one exemplary embodiment of the inventive concept, a frame rate is adjusted within a sync period of a frame synchronization signal and is precisely adjusted using a fractional divider, so that a side effect in which users perceive the change in the frame rate is prevented and power consumption is reduced.

While the inventive concept has been particularly shown and described with reference to exemplary embodiments thereof, it will be understood by those of ordinary skill in the art that various changes in forms and details may be made therein without departing from the spirit and scope of the inventive concept.

What is claimed is:

1. A device for controlling a display system, the device comprising:

a memory comprising a first lookup table (LUT) including a plurality of entries, where each entry includes a frame number of a corresponding one of a plurality of sequential frames, a first value, and a second value and where the first and second values are natural numbers;

a controller configured to count at least one pulse of a received vertical synchronization (VSYNC) signal to obtain a frame number that corresponds to one of the plurality of sequential frames, access one of the entries of the first LUT using the obtained frame number to obtain the corresponding first and second values, and change a value of M to the obtained first value and change a value of N to the obtained second value in synchronization with a pulse of the received VSYNC signal;

a fractional divider configured to generate and output a pixel clock signal by dividing an input clock signal by a division ratio of the changed value of N to the changed value of M; and a display controller configured to adjust a frame rate of the display system according to the pixel clock signal, wherein the frame rate is a certain number of frames per second calculated by multiplying the changed value of N by the changed value of M and dividing a result of the multiplying by 60.

2. The device of claim 1, wherein the controller receives a scenario signal relating to an operation scenario of the display system and refers to one of the first look-up table and a second other look-up table of the memory according to the scenario signal.

3. The device of claim 1, wherein the controller changes the values of M and N within a sync period while the pulse occurs in the VSYNC signal and the fractional divider changes a frequency of the pixel clock signal in the sync period according to the changed values of M and N.

4. The device of claim 1, wherein the controller transmits a reference request signal to the memory to access the first LUT, and wherein the reference request signal includes the obtained frame number, information about whether to increase or decrease the frequency of the pixel clock signal, and a target frequency according to the change in the frequency of the pixel clock signal.

5. The device of claim 1, wherein the device is implemented as one of an application processor or a system-on-chip, and the display system is implemented as a television system.

6. The device of claim 1, wherein the device is implemented as an application processor, and wherein the controller and the fractional divider are comprised in a clock management unit of the application processor.

7. The device of claim 1, wherein the first value and the second value are different from one another and both greater than 1.

8. A display system comprising:

a display device configured to display images only outside a period while a pulse occurs within a vertical synchronization (VSYNC) signal;

a first controller configured to generate the VSYNC signal and output image data to the display device according to a pixel clock signal;

a second controller that is configured to count at least one pulse of the VSYNC signal to obtain a frame number that corresponds to one of a plurality of sequential frames, retrieve a first value and a second value from an entry in a lookup table corresponding to the obtained frame number, and change a value of N to the retrieved first value and change a value of M to the retrieved second value, where the retrieved first and second values are natural numbers; and a fractional divider configured to divide an input clock signal by a division ratio of the changed value of N to the changed value of M only within the period to generate the pixel clock signal, wherein the first controller is configured to adjust a frame rate of the display system according to the pixel clock signal, wherein the frame rate is a certain number of frames per second calculated by multiplying the changed value of N by the changed value of M and dividing a result of the multiplying by 60.

9. The display system of claim 8, wherein a value of a frequency of the pixel clock signal is proportional to a value of a frame rate of the display device.

10. The display system of claim 8, wherein the second controller is configured to change the values of the N and M only within the period.

11. The device system of claim 8, wherein the retrieved first value and the retrieved second value are different from one another and both greater than 1.

* * * * *